US009693613B2

(12) United States Patent
Walsh

(10) Patent No.: US 9,693,613 B2
(45) Date of Patent: Jul. 4, 2017

(54) TABLETOP EARRING STORAGE ORGANIZER DISPLAY DEVICE

(71) Applicant: Donna Walsh, Monroe, NY (US)

(72) Inventor: Donna Walsh, Monroe, NY (US)

( * ) Notice: Subject to any disclaimer, the term of this patent is extended or adjusted under 35 U.S.C. 154(b) by 0 days.

(21) Appl. No.: 15/367,559

(22) Filed: Dec. 2, 2016

(65) Prior Publication Data

US 2017/0079395 A1 Mar. 23, 2017

Related U.S. Application Data

(60) Continuation-in-part of application No. 14/243,407, filed on Apr. 2, 2014, now abandoned, which is a division of application No. 13/849,174, filed on Mar. 22, 2013, now Pat. No. 8,727,110.

(60) Provisional application No. 61/619,782, filed on Apr. 3, 2012.

(51) Int. Cl.

| | |
|---|---|
| ***B65D 75/00*** | (2006.01) |
| ***A45C 11/16*** | (2006.01) |
| ***A47F 7/02*** | (2006.01) |
| ***A47F 5/11*** | (2006.01) |

(52) U.S. Cl.

CPC ..... *A45C 11/16* (2013.01); *A47F 5/11* (2013.01); *A47F 7/02* (2013.01)

(58) Field of Classification Search

USPC ..... 206/566, 6.1

See application file for complete search history.

(56) References Cited

U.S. PATENT DOCUMENTS

| | | | | |
|---|---|---|---|---|
| 5,427,230 | A * | 6/1995 | Mattox | A47G 25/14 206/478 |
| 5,924,695 | A * | 7/1999 | Heykoop | A63F 9/00 273/440 |
| 2012/0205262 | A1* | 8/2012 | Bland | A45C 7/0077 206/6.1 |
| 2013/0256159 | A1* | 10/2013 | Walsh | A45C 11/16 206/6.1 |
| 2014/0021091 | A1* | 1/2014 | Egli | B65D 65/38 206/736 |
| 2015/0230575 | A1* | 8/2015 | Gort | A45C 11/26 53/467 |
| 2016/0150895 | A1* | 6/2016 | Conley | A47G 25/14 211/85.2 |

* cited by examiner

*Primary Examiner* — Jacob K Ackun
(74) *Attorney, Agent, or Firm* — Buckingham, Doolittle & Burroughs, LLC

(57) ABSTRACT

A tabletop earring storage organizer display device comprising a singular sheet of ridged bamboo woven wood material, a plurality of perforated tabs for retaining post earrings, and a fabric lining to cover the wire backs of hook earrings. The singular sheet of bamboo woven wood can be manipulated and shaped into form a hollow cylindrical form that is able to stand unassisted on a flat surface to retain and display post and hanging hook earrings. The hollow cylindrical form can be re configured and rolled into a scroll formation to consolidate the retained earrings within the scroll formation.

1 Claim, 2 Drawing Sheets

TABLETOP EARRING STORAGE ORGANIZER DISPLAY DEVICE

CROSS-REFERENCE

This application is a Continuation in Part Application of Non Provisional application Ser. No. 14/243,407 filed Apr. 2, 2014, which is a Divisional Application of Non Provisional application Ser. No. 13/849,174 filed on Mar. 22, 2013, now U.S. Pat. No. 8,727,110, which claims priority from Provisional Patent Application Ser. No. 61/619,782 filed Apr. 3, 2012.

BACKGROUND

Today's fashion trends incorporate a large amount of jewelry into accessorizing fashion designs. Earrings in particular, are a jewelry item most women and teenage girls use daily to accessorize their outfits. Throughout the years, jewelry accessorizing has remained a popular fashion trend, and the earrings collections of women will undoubtedly continue to grow, thus more efficient and effective means to display, store and organize earrings is needed. Furthermore, as many individuals have limited space within their homes for storage, having a compact space saving means to display, store and organize earrings is also beneficial.

Current earring storage devices do not provide effective, space saving earring storage, nor do they provide multiple benefits to use. Some current earring storage devices are made to be hung in a closet, and some are closed containers, such as jewelry boxes. These storage items do not provide a direct view of earrings, nor do they provide a quick, convenient easy access to earrings. Some hanging storage devices are made of soft fabric. Though these devices may have the ability to rollup, in order to commence the rollup action, the device must first be removed from the hanging source, then the device must be placed on a flat surface in order to properly roll the device up into the scroll formation. This is both a tedious and time consuming process, that does not yield a quick method for earring consolidation. Furthermore, as these devices are made of soft fabric, they do not present with a hard outer surface to protect earrings from becoming damaged while in transport. Jewelry boxes and containers, though they can rest on a table top, do not display earrings in direct view in an open at a glance manner. The user must open the box or container and search through the various compartments within the box to find desired earrings. Again, a time consuming and tedious process. Additionally, jewelry boxes and containers are too bulky to be transported, as well as too bulky to be hidden away to minimize the possibility of theft. Some earring storage organizers have clear pockets for retaining earrings. With this type of organizer, the earrings drop to the crease of the pocket making it hard to see the earrings and even harder to retrieve them. There are also some wall hanging earring display organizers. These types of organizers are stationery and cannot provide earring transport. Additionally, the user must hang this device on a hook on a wall, which will damage the wall. Other earring storage devices are hard display forms made specifically for earring display. These forms are stationary storage devices, which do not yield the ability to transform to consolidate earrings for transport.

The present invention provides women with a compact earring storage solution that effectively retains a large collection of earrings in an organized compact, space saving manner, providing an easy access to all earrings. The tabletop earring storage display device can stand unassisted on any flat surface to provide a convenient direct view display of earrings. It can also quickly convert and transform into an earring storage travel scroll right from its standing display position to provide an additional discrete earring storage option and easy earring transport. The compact space saving storage scroll can either remain standing on a tabletop or it can be placed in a more discrete location, to minimize the possibility of theft. Women can also bring the compact earring storage scroll with them when traveling. As the scroll maintains a hard outer surface, earrings will be protected from becoming damaged while in transit. None of the current earring storage organizers mentioned above can provide all the multiple benefits of the tabletop earring storage organizer display device of the present invention.

SUMMARY

The following presents a simplified summary in order to provide a basic understanding of some of the aspects of the disclosed innovation. This summary is not an extensive overview, and is not intended to identify key/critical elements or to delineate the scope thereof. Its sole purpose is to present some concepts in a simplified form as a prelude to the more detailed description that is presented later.

The subject matter disclosed and claimed herein, comprises a tabletop earring storage organizer display device that provides for a more effective and efficient way to retain, organize, display and travel with a large amount of earrings. The tabletop earring storage organizer display device comprises a generally elongated singular sheet of bamboo woven wood material comprising a right edge, a left edge, a back surface and a front surface. A plurality of perforated tabs is secured onto the front surface of the elongated singular sheet of bamboo woven wood for the purpose of retaining post earrings. Hanging earrings are retained directly on the front surface of the elongated singular sheet of bamboo woven wood where the tabs are not present. A fabric lining is attached to the back surface of the singular sheet of bamboo woven wood for the purpose of earring protection. The singular sheet of bamboo woven wood can be manually manipulated and configured into the shape of a hard ridged hollow cylindrical form which maintains the integral structure to stand unassisted on a tabletop. Both post and hanging earrings are retained and displayed on the front surface of the cylindrical form. Once the earrings are attached to the cylindrical hollow form, the form can also be reconfigured and rolled into a tight compact ridged earring storage travel scroll right from its standing tabletop position, to provide an additional discrete earring storage, and earring transport option. The scroll can also stand unassisted on a tabletop. The hard ridged outer surface of the scroll protects the earrings contained within the scroll from possible damage when in transport. The earring storage scroll can also quickly unroll, and the elongated singular sheet can be reconfigured to convert back into the hollow cylindrical display form right from its standing position.

Certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF THE PREFERRED EMBODIMENTS

Figure 1:
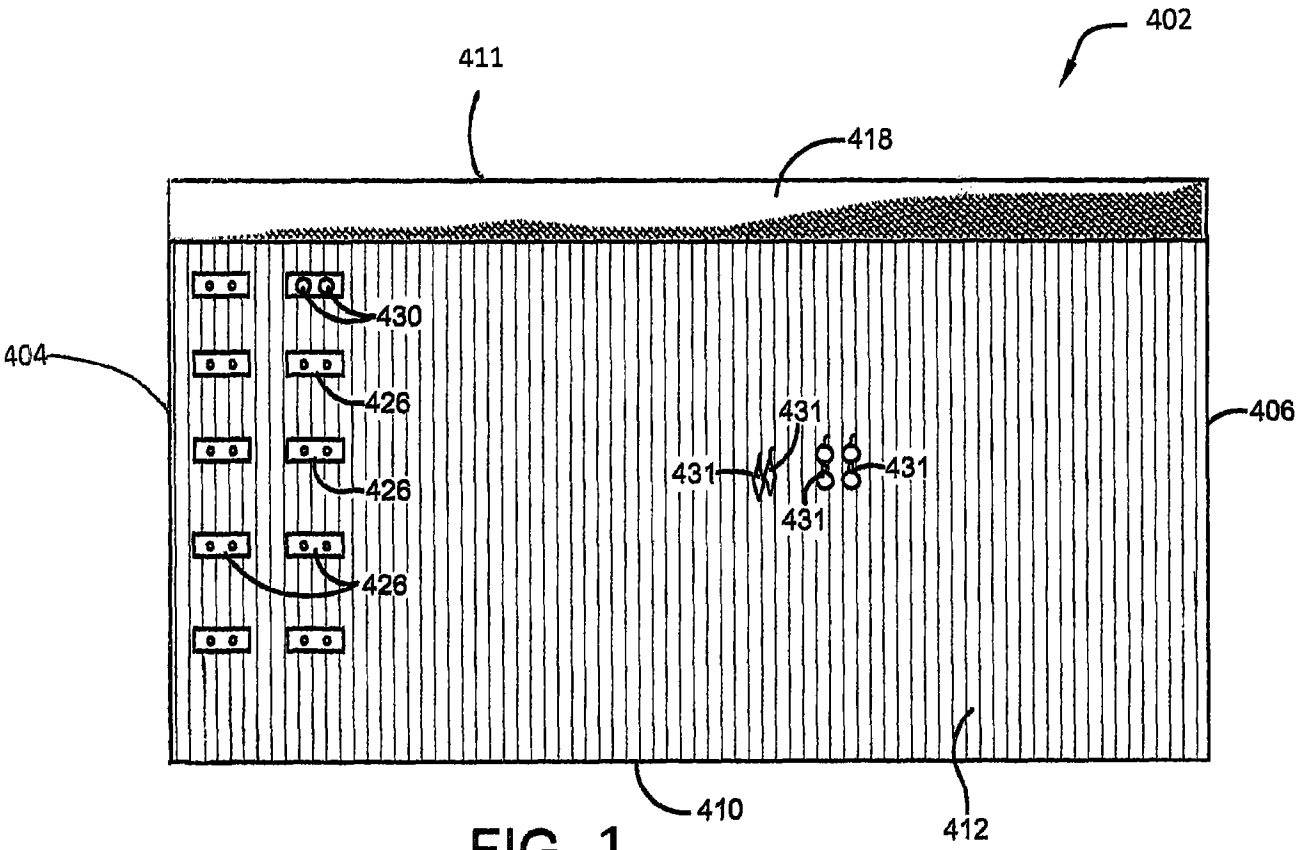
FIG. 1 illustrates a front perspective view of the front surface of the elongated rectangular singular sheet of bamboo woven wood material in accordance with the disclosed architecture. The sheet material is depicted in an upright erect position. The bamboo reeds or slats that are present within the weave of the woven material are also depicted in a vertical position.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without the specific details. In other instances, well-known structures and devices are shown in block diagram form in order to facilitate a description thereof.

The present invention provides a tabletop earring storage organizer display device that focuses on the need for a more compact, space saving way to display, store and travel with a large amount of earrings. The device provides a simple uncomplicated storage concept that yields a quick convenient access to earrings. The earring storage display device comprises an elongated ridged and flexible sheet of bamboo woven wood, a plurality of perforated tabs for retaining post earrings, and a fabric lining which functions to cover the wire backs of hook earrings once they have been retained on the front surface of the elongated sheet of bamboo woven wood. Furthermore, the fabric lining also serves as a decorative component when the elongated sheet of bamboo woven wood is rolled into a scroll formation. The display storage device is configured into the shape of a ridged hollow cylindrical form able to stand erect unassisted on a flat surface for the purpose of retaining earrings. The hollow cylindrical form can easily be reconfigured and rolled to transform into a compact ridged scroll for earring containment and earring transport. The scroll also has the ability to stand erect unassisted on a flat surface such as a tabletop.

Figure 2:
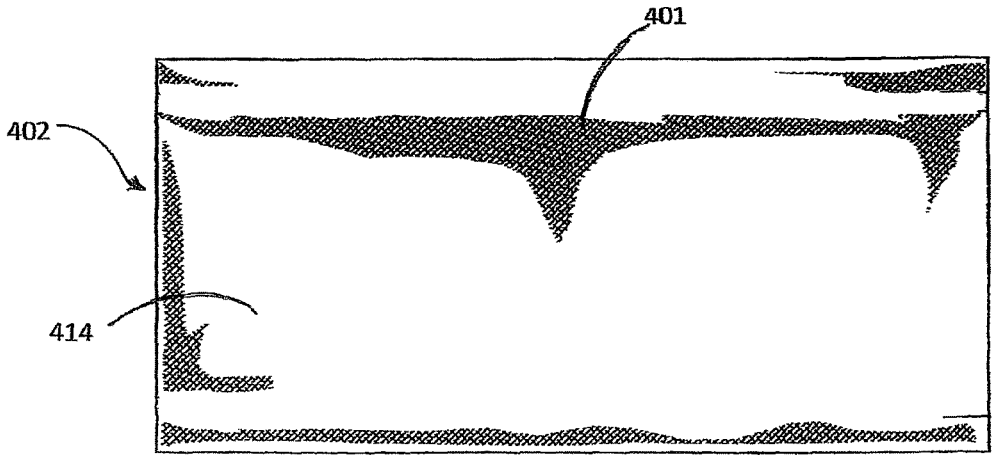
FIG. 2 illustrates a back perspective view of the elongated rectangular singular sheet of the bamboo woven wood material sheet in accordance with the disclosed architecture. The back view of the elongated rectangular sheet of bamboo woven wood is depicted with a fabric lining attached to the back surface.
Figure 3A:
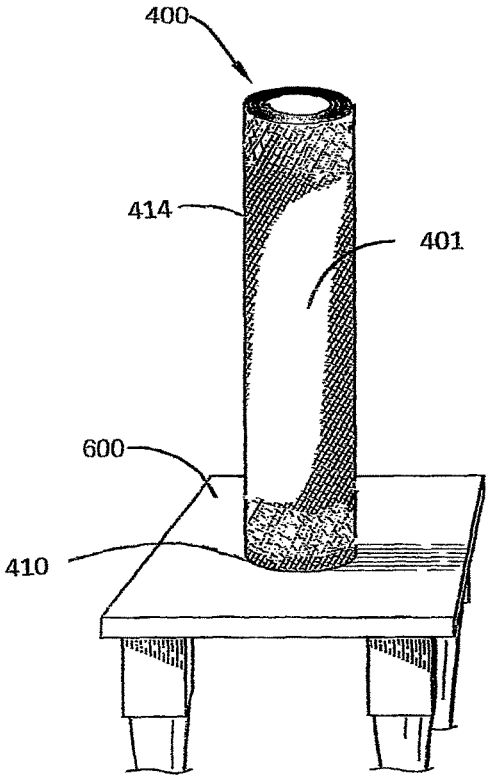
FIG. 3A illustrates a front perspective view of the earring storage organizer device when the elongated singular sheet of bamboo woven wood is rolled into a tight scroll formation. The scroll form is depicted standing unassisted on a tabletop in accordance with the disclosed architecture.
Figure 3:
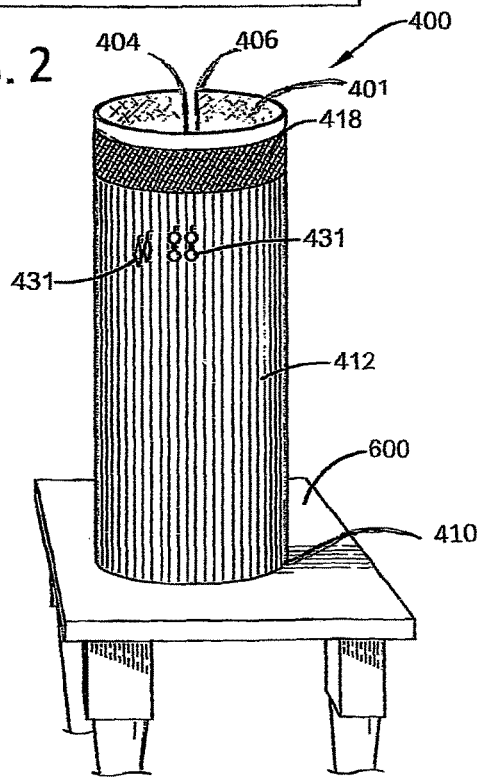
FIG. 3 illustrates a front perspective view of the earring storage organizer display device when the elongated singular sheet of bamboo woven wood is configured into the shape of a hollow cylindrical form. The cylindrical form is depicted standing unassisted on a tabletop in accordance with the disclosed architecture.

Referring initially to the drawings, FIGS. 1-3 and 3A illustrate all the components that comprise a free standing table top earring storage organizer display device 400. The earring storage organizer display device 400 provides a more efficient and compact way to display, house, organize, and also transport a large amount of earrings. The table top earring storage organizer device 400 has the ability to stand unassisted in an erect vertical position on any flat surface, including a table top 600, for the purpose of retaining and displaying earrings 430 and 431. The table top earring storage organizer device 400 comprises a generally elongate singular sheet 402 of bamboo woven wood material comprising a left edge 404, a right edge 406, a top edge 411 and a bottom edge 410. Typically, the elongated singular sheet 402 is rectangular in shape, however any other shape can be used as known in the art without compromising the overall concept of the invention. The elongated singular sheet 402 of bamboo woven wood maintains both ridged and pliable properties. The elongated singular sheets 402 flexible properties enable the elongated singular sheet 402 to be manipulated and configured into the shape of a ridged hollow cylindrical form, where earrings 430 and 431 are retained and displayed on the front outer surface 412 of the cylindrical form. The elongated singular sheets 402 ridged properties allow the cylindrical form to stand erect unassisted on a flat surface. Though the cylindrical form is the general shape of the earring storage organizer display device 400 when its in its standing position on a table top 600 (as show in FIG. 3), other shapes can be utilized, as long as the shape does affect the overall concept of the invention. Earrings 430 and 431 are retained and displayed on the front surface 412 of the elongated singular sheet 402 when shaped into the hollow cylindrical form. The table top 600 earring storage organizer device 400 also has the ability to transform while standing erect on a table top 600 (as shown in FIG. 3), into a free standing compact ridged storage scroll (as shown in FIG. 3A). The ridged storage scroll is also able to stand erect unassisted for the purpose of compact discrete earring 430 and 431 containment, and or transport. The user can conveniently manipulate and reshape the cylindrical shaped table top 600 earring storage organizer device 400 into a compact ridged storage travel scroll, while the device 400 remains in its erect vertical standing position on a table top 600 providing the user with a quick way to compact earrings 430 & 431 within a scroll to also provide an additional discrete and portable storage option. The scroll can also quickly unroll, so that the elongated singular sheet 402 can once again be reconfigured and converted back into the ridged cylindrical form of the tabletop 600 earring storage organizer display device 400. This can be achieved while the scroll is in its tabletop standing position resting on its bottom edge 410.

The elongated singular sheet 402 would generally be constructed of bamboo woven wood sheet material. Bamboo woven wood is a type of sheet material that is not cloth or fabric. This type of material is developed on a special weaving loom. Thin reeds or flat slats of wood which are approximately 2/16 to 3/16 inches in thickness are laid flat and woven together with thread on a special weaving loom to form this sheet material. All types of wood reeds or slats, such as oak, teak, etc., can be used in the construction of this material. These reeds or slats can also be made from synthetic materials such as hard plastics, providing it does not compromise the overall concept of the invention. Various types of threads can also be used in the weaving process such as cotton thread, polyester thread, nylon thread etc. The threads can also be of various colors. Additionally, the nylon thread can also be clear translucent nylon, as to create stitching that is not visible. Many stitching patterns can also be used to bind the reeds or slats of bamboo together to form a flat pliable material sheet. Once this material sheet is developed, it maintains both ridged properties and flexible properties. The solid wood reeds or slats give the material its ridged properties and the threaded weave is what creates the materials flexible properties. This sheet material, once constructed, may be cut into many sizes. When this type of material sheet is held upright so that the reeds or slats that are present within the weave are in a vertical position, the ends of the reeds or slats can rest on any flat surface such as a tabletop 600. From this position the elongated singular sheet 402 of bamboo woven wood will maintain flexibility from its right edge 406 to its left edge 404. The flexibility of the elongated singular sheet 402 allows a user to manipulate and shape the elongated singular sheet 402 of bamboo woven wood into a hard cylindrical shaped form which is able to stand unassisted on any flat surface to retain and display earrings 430 and 431. The flexibility also allows the user to configure and roll the elongated sheet 402 into a scroll formation for the purpose of discrete earring 430 and 431 consolidation and transport.

The bamboo reeds or slats that are present within the elongated singular sheet 402 can also comprise a variety of colors to suit the user and manufacturers preference. Further the elongated singular sheet 402 is approximately between 17 and 18 inches high measuring from the top end 411 to the bottom end 410 of the singular elongated sheet 402, and between 16 and 17 inches wide measuring from the left edge 404 to the right edge 406. This is the size similar to that of a table place mat. However, the elongated singular sheet 402 can also be of various widths and heights. The thickness of the elongated singular sheet 402 is approximately 2/16 to 3/16 inches in thickness measuring from the front surface 412 to the back surface 414 of the elongated singular sheet 402.

Typically, the elongated singular sheet 402 comprises a fabric lining 401 that is secured to the back surface 414 of the elongated sheet 402. This fabric lining 401 is both a functional and decorative component of the innovation. The fabric lining 401 is an important functional component of the device 400 as it stops the wire backs of the hanging earrings 431 that have been pierced through the front surface 412 of the singular sheet 402 of bamboo woven wood from becoming tangled and caught up with the earrings 430 and 431 that are retained and are displayed on the front surface 412 of the singular sheet 402, when the singular sheet 402 is being rolled to form a compact storage travel scroll. Once the storage travel scroll configuration is completed, the fabric lining 401 will also act as a visible decorative covering for the compact scroll (as shown in FIG. 3A). Further, the fabric lining 401, is secured to the back surface 414 of the singular sheet 402 (as shown in FIG. 2) via any suitable securing means as is known in the art, such as sewing, gluing, etc.

Additionally, the elongated singular sheet 402 can comprise a decorative fabric banding 418 secured onto the front surface 412 of the singular sheet 402. It is secured onto the singular sheet 402 just below the top edge 411 of the elongated singular sheet 402, and is secured on all the way across the elongated singular sheet 402 from the left edge 404 to the right edge 406 (as shown in FIG. 1). The fabric banding 418 is secured onto the singular sheet 402 via any suitable means known in the art such as sewing, gluing, etc.

The elongated singular sheet 402 further comprises a plurality of perforated tabs 426 secured onto the front surface 412 of the elongated singular sheet of bamboo woven wood 402 (as shown in FIG. 1) for retaining post earrings 430. The post earrings 430 are secured directly on to the perforated tabs 426 by means of pushing the post portion of the post earring 430 through the perforated portion of the perforated tab 426. The post earrings 430 are then secured onto the perforated tab 426 with the backing securement of the post earring 430. The perforated tabs 426 can be made out of various types of fabric, leather or vinyl. The plurality of perforated tabs 426 is secured onto the elongated singular sheet 402 via any suitable securing means known in the art such as sewing, gluing, etc. The plurality of perforated tabs 426 can be secured onto the elongated singular sheet 402 in any suitable configuration. The remaining area on the front surface 412 of the elongated singular sheet 402, where the perforated tabs 426 are not present, is where the hanging earrings 431 are retained by means of piercing the end of the wire hook portion of the hanging earrings 431 through the weave of the elongated singular sheet 402 of bamboo woven wood material.

The tabletop earring storage organizer display device 400, is generally the shape of a hollow cylindrical form. The tabletop earring storage organizer display device 400 has the ability to stand erect on a table top 600 unassisted where earrings 430 and 431 are retained and displayed on the outer front surface 412 (as shown in FIG. 3). Typically, to create this hollow cylindrical form, a user must hold the elongated singular sheet 402 in an upright position so the reeds or slats that are present within the elongated singular sheet 402 material are in a vertical position, and the front surface 412 of the singular sheet 402 is facing outward towards the user. The user can then rest the bottom end 410 of the singular elongated sheet 402 on a flat surface such as a table top 600. The user then curves the right edge 406 of the singular sheet 402 back in a counterclockwise direction, then curves the left edge 404 of the elongated singular sheet 402 back in a clockwise direction till both the left edge 404 and right edge 406 meet, forming a hollow cylindrical form. While in this position, the hollow cylindrical form maintains enough integral structure to allow the cylindrical form to stand erect unassisted on a table top 600 (as shown in FIG. 3) to retain and display earrings 430 and 431. The inside portion of the cylindrical form is the back surface 414 of the elongated singular sheet 402. As the back surface 414 of the elongated singular sheet 402 is lined with the fabric lining 401, the fabric lining 401 will be present on the inside portion of the hollow cylindrical form when the cylindrical shape is created.

The elongated singular sheet 402 when formed into the hollow cylindrical form, can also quickly transform into a compact storage travel scroll for the purpose of discrete earring 430 and 431 storage and or transport. The outer portion of the scroll will maintain a hard surface which acts to protect earrings 430 and 431 from becoming damaged when the scroll is being transported. The scroll formation can be achieved by reconfiguring the elongated singular sheet 402 while it is in the hollow cylindrical display shape. Once transformed into the compact storage travel scroll, the scroll can also remain standing erect unassisted on a table top 600. When in this scrolled position, the fabric lining 401 presents as a decorative outer covering for the compact storage travel scroll, making it aesthetically pleasing to leave the compact storage scroll out on the tabletop 600 in direct view (as shown in FIG. 3A). To transform the hollow cylindrical shaped earring storage organizer device 400 into a compact storage travel scroll, the user takes hold of the right edge 406 of the elongated singular sheet 402 where it has met the left edge 404 when the elongated singular sheet 402 has been shaped into the hollow cylindrical form. The user then begins to roll the right edge 406 of the elongated singular sheet 402 in a clockwise direction. As the user commences the rolling action, the back surface 414 of the elongated singular sheet 402 will continue to roll over the front surface 412 of the singular sheet 402 till the scroll formation is completed and the right edge 406 meets the left edge 404 of the elongated singular sheet 402. The rolling action can take place right on the tabletop while the earring storage organizer device 400 is in its standing cylindrical display position. While rolling, the fabric lining 401 that is attached to the back surface 414 will lay over the front surface 412 with each roll protecting the earrings 430 and 431 from becoming tangled up with the wire hooks of the hook earrings 431 that are protrude through the back surface 414 of the elongated sheet 402 after they have been pierced through the front surface 412 for retention. The user rolls all the way to the left edge 404 of the elongated singular sheet 402 to complete the scroll formation. When the scroll formation is completed, the fabric lining 401 will now present as an outer decorative covering for the travel storage scroll. The user can then tie the scroll closed with a ribbon or other appropriate cording material.

To transform the earring storage travel scroll back into the cylindrical shape of the earring storage organizer display device 400, the user, while the scroll is standing unassisted on a tabletop 600, first unties the closure ribbon or cording. Then the user takes hold of the left edge 404 of the elongated singular sheet 402, which is the edge that is exposed after the scroll formation has been completed. Then while holding on to the left edge 404, the user begins to unroll the scroll formation in a counter clockwise direction till the scroll is fully unwound and the elongated singular sheet 402 is no longer in the scroll formation. With the elongated singular sheet 402 back in a straight vertical position as (shown in FIG. 1), the user now curves the right edge 406 back in a counter clockwise direction and the left edge 404 back in a clockwise direction till the right edge 406 meets the left edge 404 to once again form the hollow cylindrical form, which comprises the shape of the earring storage organizer display device 400 (as shown in FIG. 3).

What has been described above includes examples of the subject matter. It is of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the scope of the appended claims.

What is claimed is:

1. A tabletop earring storage organizer display device, comprising a generally elongated rectangular singular sheet of ridged bamboo woven wood material comprising a right edge, left edge, top edge, bottom edge, back surface and front surface;

a plurality of perforated tabs secured onto the front surface of the singular sheet of bamboo woven wood for securing post earrings;

a fabric lining secured to the back surface of the singular sheet of bamboo woven wood to cover the wire backs of the hook earrings;

wherein the singular sheet of bamboo woven wood can be manipulated and shaped into a ridged hollow cylindrical form for the purpose of retaining and displaying both post and hook earrings on the front surface of the cylindrical form;

wherein the ridged properties of the bamboo woven wood provide enough integral structure to allow the hollow cylindrical form to stand unassisted on a flat surface such as a tabletop to retain and display earrings;

wherein the ridged singular sheet of bamboo woven wood, after it has been shaped into the hollow cylindrical form can be reconfigured and rolled into a scroll formation to consolidate the retained earrings within the scroll formation, providing a means for discrete earring storage and earring transport;

wherein the scroll formation also maintains the integral structure to stand unassisted on a flat surface such as a tabletop; and wherein the scroll formation can easily be unrolled, and the elongated sheet of bamboo woven wood can once again be reshaped into a ridged hollow cylindrical form for earring retention and display.

* * * * *